US007325774B2

(12) United States Patent
Jun et al.

(10) Patent No.: US 7,325,774 B2
(45) Date of Patent: Feb. 5, 2008

(54) GABION UNIT AND GABION MESH COMPRISING IT

(76) Inventors: Wan Jin Jun, 48, Kimyong-ri, Youngsun-myun, Munkyung-si, Gyeongsangbuk-do 745-852 (KR); Soo Young Huh, #1612, Samick APT. 330, Noryangjin 1-dong, Dongjak-gu, Seoul 156-051 (KR)

( * ) Notice: Subject to any disclaimer, the term of this patent is extended or adjusted under 35 U.S.C. 154(b) by 33 days.

(21) Appl. No.: 10/560,780

(22) PCT Filed: Jun. 16, 2004

(86) PCT No.: PCT/KR2004/001441

§ 371 (c)(1),
(2), (4) Date: Dec. 14, 2005

(87) PCT Pub. No.: WO2004/111345

PCT Pub. Date: Dec. 23, 2004

(65) Prior Publication Data

US 2006/0131463 A1 Jun. 22, 2006

(30) Foreign Application Priority Data

Jun. 17, 2003 (KR) ..... 10-2003-0039245

(51) Int. Cl.

| | |
|---|---|
| ***B21F 27/00*** | (2006.01) |
| ***B21F 27/08*** | (2006.01) |
| ***B21F 27/12*** | (2006.01) |
| *B21F 3/00* | (2006.01) |
| *B21F 15/00* | (2006.01) |

(52) U.S. Cl. ..... 245/2; 245/3; 245/4; 245/5; 245/7; 245/8; 245/9; 245/11

(58) Field of Classification Search ..... 2/2–5, 2/7–9, 11

See application file for complete search history.

(56) References Cited

U.S. PATENT DOCUMENTS

| | | | | |
|---|---|---|---|---|
| 1,491,364 | A * | 4/1924 | Taylor | 245/8 |
| 1,859,831 | A * | 5/1932 | Land | 245/7 |
| 1,914,007 | A * | 6/1933 | Carrie | 245/2 |
| 2,194,222 | A * | 3/1940 | Ewing | 245/11 |
| 3,087,699 | A * | 4/1963 | Foster | 428/107 |
| 3,682,419 | A * | 8/1972 | Vanderfaeillie | 245/7 |
| 4,081,159 | A * | 3/1978 | Baldwin | 245/2 |
| 4,154,429 | A * | 5/1979 | Brannan | 256/10 |
| 4,394,924 | A * | 7/1983 | Zaccheroni | 220/486 |
| 5,333,970 | A * | 8/1994 | Heselden | 405/286 |
| 5,334,440 | A * | 8/1994 | Halterbeck et al. | 428/222 |
| 5,472,297 | A * | 12/1995 | Heselden | 405/286 |
| 5,795,835 | A * | 8/1998 | Bruner et al. | 442/310 |
| 5,965,467 | A * | 10/1999 | Stevenson et al. | 442/218 |
| 6,020,275 | A * | 2/2000 | Stevenson et al. | 442/60 |
| 6,056,479 | A * | 5/2000 | Stevenson et al. | 405/302.7 |
| 6,168,118 | B1 | 1/2001 | Vancraeynest et al. | |
| 6,733,211 | B1 * | 5/2004 | Durie | 139/383 R |
| 6,823,901 | B1 * | 11/2004 | Garcia | 140/92.7 |
| 6,857,817 | B2 * | 2/2005 | Rothfuss | 405/32 |
| 2003/0145526 | A1 * | 8/2003 | Rothfuss | 52/5 |
| 2005/0263564 | A1 * | 12/2005 | Garcia et al. | 228/4.5 |

FOREIGN PATENT DOCUMENTS

| | | | |
|---|---|---|---|
| EP | 0429106 | | 5/1991 |
| JP | 09-296430 | | 11/1997 |
| JP | 09296430 | A * | 11/1997 |
| JP | 2001-207428 | | 8/2001 |
| JP | 2005146737 | A * | 6/2005 |
| KR | 200279894 | | 7/2002 |
| WO | WO 2004111345 | A1 * | 12/2004 |

* cited by examiner

*Primary Examiner*—Robert H. Muromoto
(74) *Attorney, Agent, or Firm*—Greenblum & Bernstein, P.L.C.

(57) ABSTRACT

A spiral double-twisted structure is provided having an n-th upper steel wire ($A_n$) and an n-th lower steel wire ($B_n$) which are paired with each other and rotated in one direction to form a front spiral twisted structure having a plurality of twists. Further, a k-th transverse steel wire ($C_k$) may be transversely inserted between the n-th upper steel wire ($A_n$)and the n-th lower steel wire ($B_n$)of the front spiral twisted structure. Additionally, the n-th upper steel wire ($A_n$) and the n-th lower steel wire ($B_n$) may be rotated in a direction opposite to the one direction after passing over the k-th transversr steel wire ($C_k$) serving as a centerline, in order to form a rear spiral twisted structure having a plurality of twists.

9 Claims, 3 Drawing Sheets

GABION UNIT AND GABION MESH COMPRISING IT

TECHNICAL FIELD

The present invention relates to a gabion mesh known as a basket or cage filled with earth or rocks, and more particularly, to a novel gabion unit formed by two longitudinal steel wires and one transverse steel wire, and a gabion mesh having the gabion units consecutively arranged both in a right and left direction and in a fore and aft direction.

BACKGROUND ART

Generally, a gabion or gabion mesh is well known as a basket or cage filled with earth or rocks, and has basic units each of which takes the shape of a rectangle by bending two special zinc-coated steel wires or two steel wires with PVC coating further formed thereon, or a hexagon by twisting two steel wires in such a manner that the steel wires overlap with each other. Among them, a hexagonal gabion has a firm twisted structure formed by the two steel wires, and thus, is characterized in that it has a higher strength over and is stronger than a rectangular gabion. Therefore, the hexagonal gabion is recently preferred to the rectangular gabion.

As shown in FIG. 1, the hexagonal gabion is formed in such a manner that two steel wires mutually forms a twisted structure, branch off from each other and then form another identical twisted structure in cooperation with other adjacent steel wires, and subsequently branch off from each other again and then form a further identical twisted structure in cooperation with the previous adjacent steel wires or other adjacent steel wires, thereby consecutively repeating such processes. Consequently, such hexagonal basic units are formed both in the right and left direction and in the fore and aft direction, and mutually establish a consecutive connection relationship among them both in the right and left direction and in the fore and aft direction, resulting in a large gabion in the form of a steel wire mesh. At this time, the two steel wires can be differentiated into an upper steel wire A guided by an upper slider and a lower steel wire B guided by a lower slider in view of the manufacturing process of the gabion.

Further, FIG. 2 shows an improved version of such a conventional hexagonal gabion. The improved gabion is formed by inserting an additional transverse steel wire C into a twisted structure of upper and lower steel wires A and B to halve the size of a hexagon, so that the gabion can be filled with smaller fillers.

Nowadays, such a hexagonal gabion has been used in a variety of applications by using the hexagonal mesh structure. This hexagonal gabion is most widely used in the field of engineering and construction structures. In this field, for example, a gabion inclination (slope) is formed to protect a cut surface of earth and rocks in a case where there is a risk of collapse and falling rocks. Alternatively, if construction of a revetment for a road or cliff is required, a gabion mesh is assembled and filled with gravel or waste rocks (crushed rocks) having a size of 100 to 300 mm to construct a revetment. Further, in a case where a scour phenomenon has occurred or may occur in a dam or river conservation structure, a gabion mesh is assembled and filled with fillers to prevent the scour phenomenon in the dam or river conservation structure.

Particularly, when a revetment or the like is constructed as an engineering and construction structure, fillers for the revetment are gravel or crushed rocks. Thus, underground water permeating from the ground can freely flow through spaces among the fillers, thereby achieving natural drain. This eliminates a possibility that water pressure is produced inside a wall surface of the revetment. Accordingly, there is an advantage in that collapse due to water pressure can be prevented. Therefore, a gabion revetment is recently admitted as having safety higher than that of other engineering and construction structures, and also appraised as having superior performance.

Moreover, in the engineering and construction structure using the gabion mesh, ambient earth and sand or the like will be gradually filled into spaces among the empty spaces among the fillers, thereby providing soil and environments in which ambient plants can sprout and grow. Thus, there is an advantage in that the structure using the gabion mesh has superior environment-friendliness to similar structures such as concrete revetments or stone reinforcement walls in view of ecology. Therefore, the structure using the gabion mesh is recently widely used as an environment-friendly engineering and construction structure in advanced countries including Europe.

However, even though the gabion mesh has superior environment-friendliness as above, it has several critical problems due to limitations on its basic configuration as follows.

First, in such a conventional gabion mesh, both longitudinal steel wires A and B cannot be continuously supplied but one of the steel wires is cut and then supplied. This is because spirally twisted structures of the conventional gabion mesh continuously proceed only in one direction and the upper steel wire A should be cut to be relatively short and then supplied in order to form the twisted structures by consecutively spirally rotating the upper steel wire A together with the lower steel wire B in one direction while fixing the lower steel wire B as a reference. Nowadays, the upper steel wire A is called "spring steel wire" and is generally used after being cut to be remarkably shorter than the lower steel wire B.

Further, in manufacturing such a conventional gabion mesh, only an intermittently automated process rather than a fully automated process can be employed. This is because a conventional method for manufacturing the gabion mesh employs the shortly cut upper steel wire A, a plurality of upper steel wires A should be generally supplied until the gabion mesh is completely manufactured using a single lower steel wire B, and respective tie operations for the upper steel wires A to the lower steel wire B should be manually performed. Thus, there is a disadvantage in that in manufacturing the conventional gabion mesh, the manufacturing process cannot be fully automated.

Furthermore, there is a disadvantage in that skilled workers are required for manufacturing the conventional gabion mesh. This is because, upon manufacture of the conventional gabion mesh, the upper steel wires A should be repeatedly coupled to the upper slider during the manufacture thereof, and such coupling operations make the automation of the manufacturing process difficult and require craft of skilled workers.

In addition, there is a critical disadvantage in that the method for manufacturing the conventional gabion mesh has very low productivity. This is because the manufacturing process of the conventional gabion mesh is performed intermittently and depends on a partially automated process, at least two or three skilled workers are required according to the size of the gabion mesh, and it takes at least 20 to 30 minutes whenever the aforementioned coupling process is performed even by such skilled workers.

Since these problems with the manufacturing process result from the configuration itself of the conventional gabion mesh, there are insoluble limitations on the problems so far as the coupling structure of the gabion mesh or each unit of the gabion mesh is not fundamentally changed.

DISCLOSURE

Technical Problem

Figure 1:
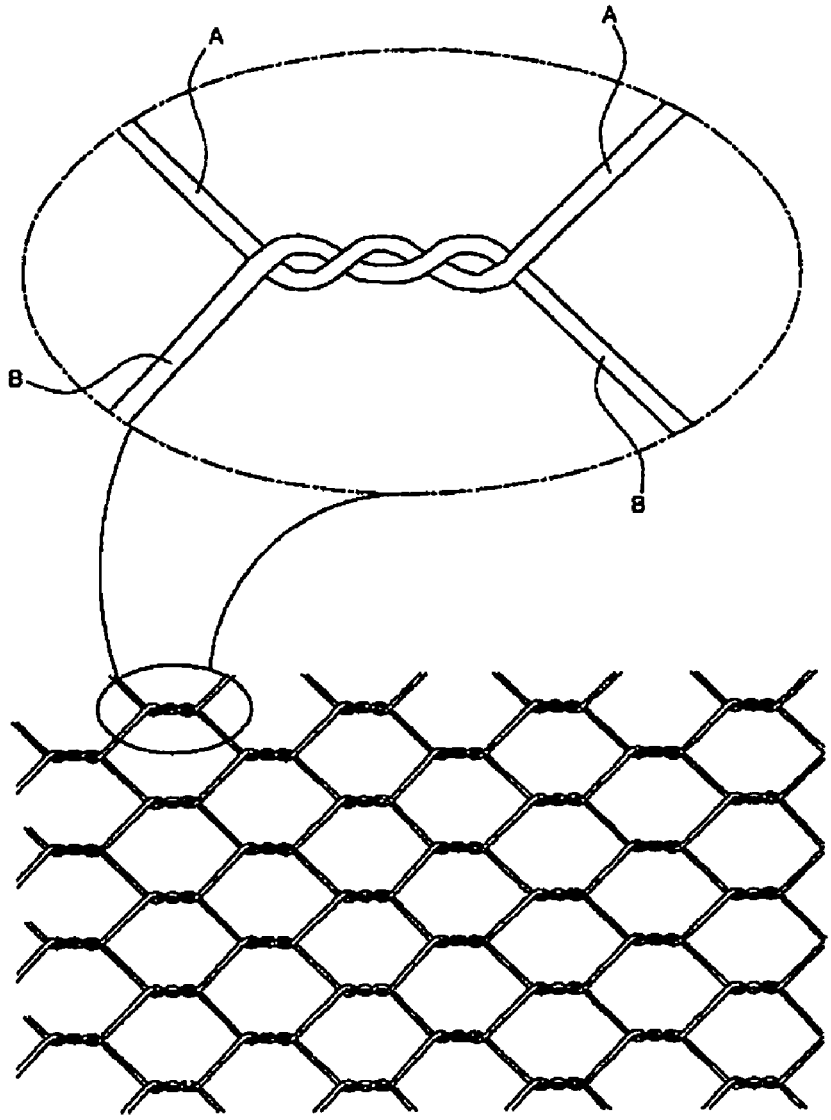
FIG. 1 is a view of a conventional hexagonal gabion with a partially enlarged view of its basic unit.
Figure 2:
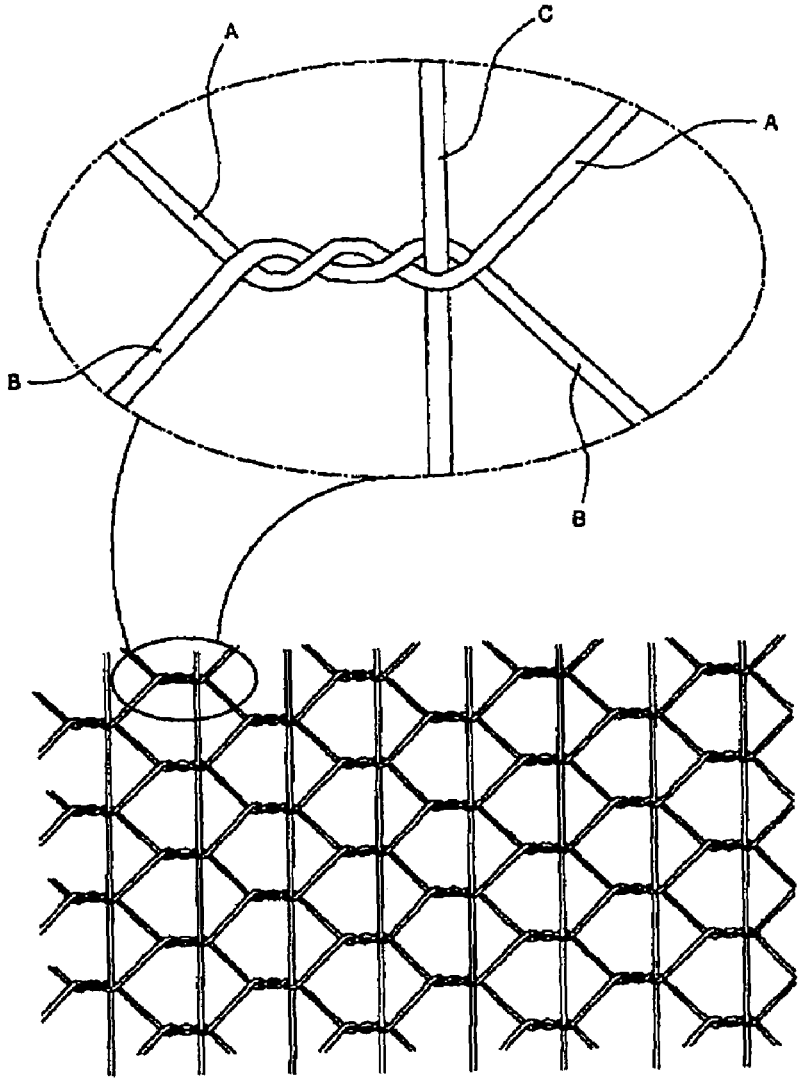
FIG. 2 is a view of an improved gabion having longitudinal reinforcement steel wires with a partially enlarged view of its basic unit.

In case of a conventional gabion mesh generally and widely used these days, skilled workers are indispensably required in view of its manufacturing process and many intermittent coupling processes should be performed during the manufacturing process. Thus, there is a disadvantage in that productivity thereof is greatly lowered.

Accordingly, an object of the present invention is to provide a spiral double-twisted structure, wherein two longitudinal steel wires and one transverse steel wire are organically coupled to one another in a manufacturing process so that a front spiral twisted structure and a rear spiral twisted structure are formed in opposite directions.

Another object of the present invention is to provide a novel gabion unit by manufacturing the spiral double-twisted structure through a continuous process.

A further object of the present invention is to provide a gabion mesh having the gabion units consecutively arranged both in a right and left direction and in a fore and aft direction.

Technical Solution

The present invention relates to a gabion unit having a novel coupling structure, and a gabion mesh having the gabion units consecutively and repeatedly arranged both in the right and left direction and in the fore and aft direction.

The gabion unit of the present invention comprises: 1) one spiral double-twisted structure including a k-th transverse steel wire $C_k$; 2) two spiral double-twisted structures including a (k+1)-th transverse steel wire $C_{k+1}$; and 3) one spiral double-twisted structure including a (k+2)-th transverse steel wire $C_{k+2}$. In the present invention, the spiral double-twisted structure refers to a structure in which two longitudinal steel wires are paired with each other to form front and rear spiral twisted structures having opposite twisting directions before and behind one transverse steel wire.

In the present invention, the k-th spiral double-twisted structure is formed in such a manner that: 1-i) an n-th upper steel wire $A_n$ and an n-th lower steel wire $B_n$ are paired with each other and rotated in one direction to form a front spiral twisted structure, 1-ii) the k-th transverse steel wire $C_k$ is transversely inserted between the n-th upper steel wire $A_n$ and the n-th lower steel wire $B_n$ of the front spiral twisted structure, and 1-iii) the n-th upper steel wire $A_n$ and the n-th lower steel wire $B_n$ are rotated in a direction opposite to the one direction after passing over the k-th transverse steel wire $C_k$ serving as a centerline, in order to form a rear spiral twisted structure.

In the present invention, the (k+1)-th spiral double-twisted structure is formed in such a manner that: 2-i) the n-th upper steel wire $A_n$ is paired with an adjacent (n+1)-th lower steel wire $B_{n+1}$ and an (n−1)-th upper steel wire $A_{n-1}$ is paired with the n-th lower steel wire $B_n$, and the pairs of steel wires are then rotated in the one direction to form front spiral twisted structures, respectively, 2-ii) the (k+1)-th transverse steel wire $C_{k+1}$ is transversely inserted between the paired two longitudinal steel wires of each of the front spiral twisted structures, and 2-iii) the paired two longitudinal steel wires are rotated in the direction opposite to the one direction after passing over the (k+1)-th transverse steel wire $C_{k+1}$ serving as a centerline, in order to form a rear spiral twisted structure.

In the present invention, the (k+2)-th spiral double-twisted structure is formed in such a manner that: 3-i) the n-th upper steel wire $A_n$ is paired again with the n-th lower steel wire $B_n$ and they are then rotated in the one direction to form a front spiral twisted structure, 3-ii) the (k+2)-th transverse steel wire $C_{k+2}$ is transversely inserted between the paired upper and lower steel wires $A_n$ and $B_n$ of the front spiral twisted structure, and 3-iii) the paired upper and lower steel wires $A_n$ and $B_n$ are rotated again in the direction opposite to the one direction after passing over the (k+2)-th transverse steel wire $C_{k+2}$ serving as a centerline, in order to form a rear spiral twisted structure.

The gabion mesh of the present invention takes the shape of a net as a whole by employing the gabion unit as a basic unit and by consecutively and repeatedly coupling the gabion units both in the right and left direction and in the fore and aft direction through consecutive and repetitive performance of the series of processes described above.

Herein, the upper and lower steel wires A and B refer to longitudinal steel wires inserted into upper and lower sliders of a gabion mesh manufacturing apparatus, and the transverse steel wire C refers to a transverse steel wire that is transversely inserted into the twisted structure formed by the upper and lower steel wires A and B. All the steel wires refer to steel wires located at relative positions.

Further, n represents herein the relative position relationship among the upper and lower steel wires A and B and is a positive integer including 0, and k represents the relative position relationship among the transverse steel wires C and is a positive integer including 0.

The gabion mesh of the present invention is characterized in that the front and rear spiral twisted structures of each gabion unit have opposite twisting directions before and behind the transverse steel wire serving as the centerline.

Advantageous Effects

As described above, the gabion mesh of the present invention has the front and rear spiral twisted structures formed by organically coupling the upper and lower steel wires and the transverse steel wire, wherein the front and rear spiral twisted structures are twisted in opposite directions before and behind the transverse steel wire serving as the centerline and also prevented from being untwisted due to the transverse steel wire.

Therefore, the upper and lower steel wires and the transverse steel wire in the gabion mesh of the present invention are firmly coupled to one another. Accordingly, there is an advantage in that a firmer mesh structure can be established.

Further, since each double-twisted structure of each gabion unit in the gabion mesh of the present invention has oppositely twisted structures, the upper and lower sliders can return to their initial positions upon manufacture of each gabion unit and thus do not rotate in only one direction. Accordingly, it is possible to fully automate the manufacture of the gabion mesh as a whole.

Best Mode

Hereinafter, the present invention will be described in detail with reference to accompanying drawings. However, it will be apparent that the accompanying drawings are merely illustrative for the purpose of more detailed description of the technical spirit of the present invention and the technical spirit of the present invention is not limited thereto.

Figure 3:
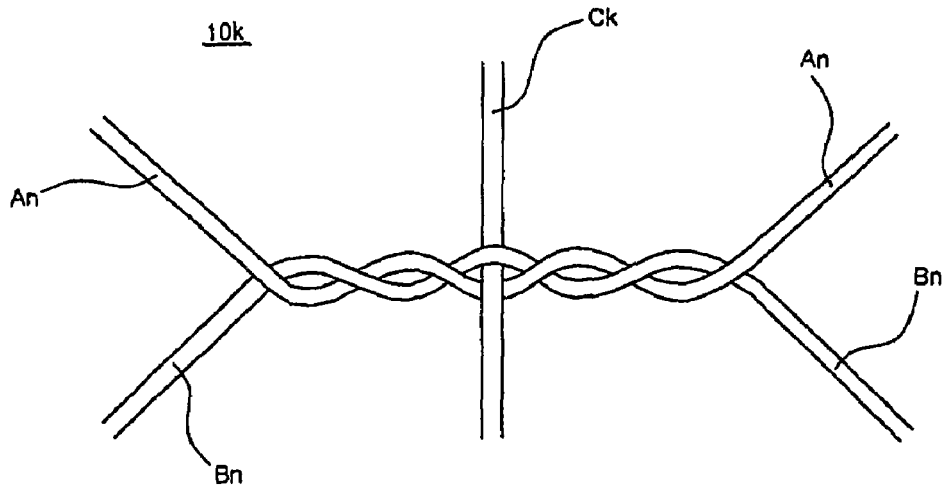
FIG. 3 is an enlarged view of a spiral double-twisted structure for constructing a gabion unit of the present invention.

FIG. 3 is a partially enlarged view of a spiral double-twisted structure $\mathbf{10}_k$ of a gabion unit constituting a gabion mesh of the present invention, showing an n-th upper steel wire $A_n$ and an n-th lower steel wire $B_n$ in a right and left direction and a k-th transverse steel wire $C_k$ in a fore and aft direction.

Figure 4:
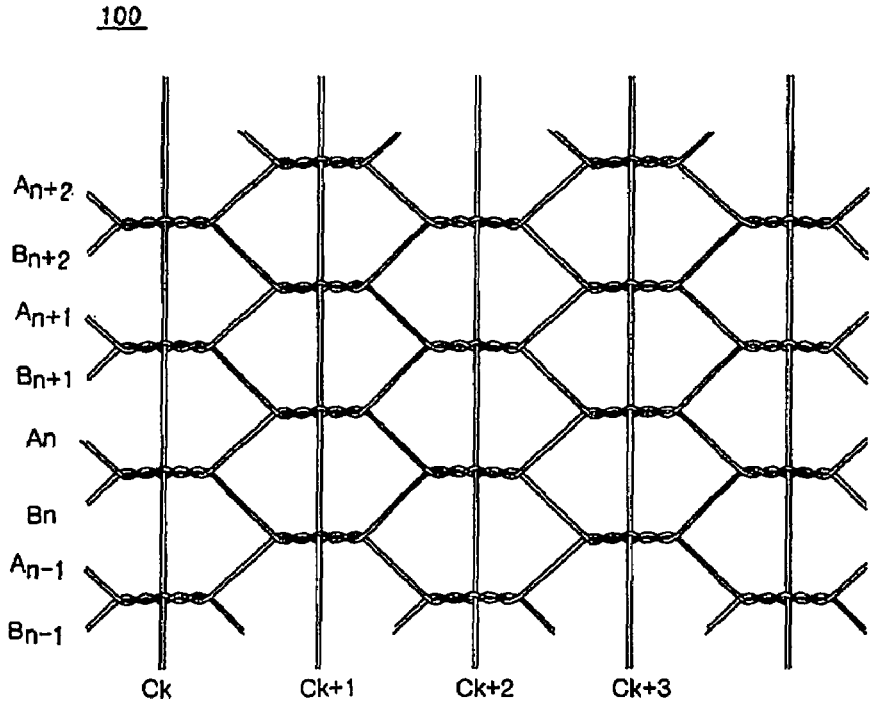
FIG. 4 is a view showing a gabion mesh of the present invention comprising a plurality of spiral double-twisted structures of FIG. 3.

FIG. 4 shows a gabion mesh 100 in which the spiral double-twisted structures $\mathbf{10}_k$ for the gabion units are consecutively and repeatedly connected to one another both in the right and left direction and in the fore and aft direction. Therefore, FIG. 4 shows that the spiral double-twisted structures for the gabion units shown in FIG. 3 are consecutively and repeatedly connected to one another both in the right and left direction and in the fore and aft direction.

The gabion unit of the present invention includes the spiral double-twisted structure $\mathbf{10}_k$ of the k-th gabion unit. FIG. 3 specifically shows the spiral double-twisted structure $\mathbf{10}_k$ of the k-th gabion unit, in which the fundamental technical spirit of the present invention is illustrated well.

In the present invention, the spiral double-twisted structure $\mathbf{10}_k$ of the k-th gabion unit comprises two spiral twisted structures arranged with respect to the k-th transverse steel wire $C_k$ and includes the n-th upper steel wire $A_n$ and the n-th lower steel wire $B_n$. The n-th upper and lower steel wires $A_n$ and $B_n$ are paired with each other and then rotated in one direction to form a front spiral twisted structure. At this time, the n-th upper steel wire $A_n$ refers to a longitudinal steel wire inserted into an n-th upper slider of a gabion mesh manufacturing apparatus, and the n-th lower steel wire $B_n$ refers to a longitudinal steel wire inserted into an n-th lower slider of a gabion mesh manufacturing apparatus. They refer to counterpart steel wires located at the same position. Further, the rotation in one direction herein may be the rotation in a clockwise or counterclockwise direction. In case of the rotation in one direction, a rotation angle is preferably integer times of 180° (i.e., $\pi^*$ p, where p is an integer other than 0) when the upper and lower steel wires $A_n$ and $B_n$ start from an upright state with respect to the ground. More preferably, the integer p is not greater than 10.

In the present invention, the spiral double-twisted structure $\mathbf{10}_k$ of the gabion unit includes the k-th transverse steel wire $C_k$ that is inserted thereinto transversely with respect to a proceeding direction of the front spiral twisted structure and located between the upper and lower steel wires $A_n$ and $B_n$. At this time, the transverse wire $C_k$ serves to provide a turning point where the upper and lower steel wires $A_n$ and $B_n$ continuously proceed after the rotation direction thereof is reversed. Therefore, the transverse steel wire $C_k$ serves to make the rear spiral twisted structure symmetrical with the front spiral twisted structure. Contrary to a spiral double-twisted structure of a conventional gabion unit which merely functions as a reinforcement means for a gabion mesh, the transverse steel wire $C_k$ has a function of preventing the untwisting of the front and rear spiral twisted structures in addition to the function as a reinforcement means.

In the present invention, the spiral double-twisted structure $\mathbf{10}_k$ of the gabion unit includes the rear spiral twisted structure formed by the upper and lower steel wires $A_n$ and $B_n$ that have passed over the transverse steel wire $C_k$ serving as a centerline. At this time, the rear spiral twisted structure is formed through reverse rotation in a direction opposite to the one direction mentioned above. Therefore, if the front spiral twisted structure is formed through clockwise rotation, the rear spiral twisted structure is formed through counterclockwise rotation. If the front spiral twisted structure is formed through counterclockwise rotation, the rear spiral twisted structure is formed through clockwise rotation. In the state where the rotation direction of the rear spiral twisted structure has been completely reversed at the transverse steel wire, a rotation angle thereof is preferably integer times of 180° (i.e., $\pi^*$ (−q), where q is an integer other than 0) when the upper and lower steel wires $A_n$ and $B_n$ start from the upright state with respect to the ground. More preferably, the integer q is not greater than 10. More preferably, the number of turns p in the front spiral twisted structure is identical with the number of turns q in the rear spiral twisted structure.

In addition, the gabion unit of the present invention further comprises spiral double-twisted structures $\mathbf{10}_{k+1}$ of a (k+1)-th gabion unit (see FIG. 4). At this time, the (k+1)-th gabion unit has two spiral double-twisted structures $\mathbf{10}_{k+1}$ each of which also has a double-twisted structure. As for the spiral double-twisted structures $\mathbf{10}_{k+1}$ of the (k+1)-th gabion unit, the n-th upper steel wire $A_n$ moves to the position of an adjacent (n+1)-th lower steel wire $B_{n+1}$ and is then in a pair, while an (n-1)-th upper steel wire $A_{n-1}$ moves to the position of the n-th lower steel wire $B_n$ and is then in another pair. In such a state, the respective pairs of steel wires proceed. At this time, the n-th upper steel wire $A_n$ is paired with the (n+1)-th lower steel wire $B_{n+1}$ and they are rotated in one direction to form a front spiral twisted structure, while the (n−1)-th upper steel wire $A_{n-1}$ is also paired with the n-th lower steel wire $B_n$ and they are rotated in one direction to form a front spiral twisted structure. Of course, the one direction may be a clockwise or counterclockwise direction. Meanwhile, a rotation angle in the one direction is preferably integer times of 180° (i.e., $\pi^*$ p, where p is an integer other than 0) when the upper steel wire $A_n$ and the lower steel wire $B_{n+1}$ start from the upright state with respect to the ground and the upper steel wire $A_{n-1}$ and the lower steel wire $B_n$ also start from the upright state with respect to the ground. More preferably, the integer p is not greater than 10.

Further, the gabion unit of the present invention comprises a (k+1)-th transverse steel wire $C_{k+1}$ that is inserted transversely with respect to a proceeding direction of the front spiral twisted structures and simultaneously located between the upper and lower steel wires $A_n$ and $B_{n+1}$ and between the upper and lower steel wires $A_{n-1}$ and $B_n$. At this time, the transverse wire $C_{k+1}$ serves to provide turning points where the upper and lower steel wires $A_n$ and $B_{n+1}$ and the upper and lower steel wires $A_{n-1}$ and $B_n$ continuously proceed after the rotation direction thereof is reversed, respectively. Therefore, the transverse steel wire $C_{k+1}$ serves to make the rear spiral twisted structures symmetrical with the front spiral twisted structures.

Further, the gabion unit of the present invention includes the rear spiral twisted structures symmetrical with the front spiral twisted structures with respect to the transverse steel wire $C_{k+1}$ serving as a centerline. At this time, the rear spiral twisted structure is formed through reverse rotation in a direction opposite to the one direction mentioned above. Meanwhile, in the state where the rotation direction of each of the rear spiral twisted structures has been completely reversed at the transverse steel wire $C_{k+1}$, a rotation angle thereof is preferably integer times of 180° (i.e., π* (−q), where q is an integer other than 0) when the upper and lower steel wires $A_n$ and $B_{n+1}$ start from the upright state with respect to the ground. More preferably, the integer q is not greater than 10. Of course, it is also true even when the upper and lower steel wires $A_{n-1}$ and $B_n$ start from the upright state with respect to the ground. More preferably, the number of turns p in the front spiral twisted structure is identical with the number of turns q in the rear spiral twisted structure.

In addition, the gabion unit of the present invention further comprises a spiral double-twisted structure $\mathbf{10}_{k+2}$ of a (k+2)-th gabion unit. The spiral double-twisted structure $\mathbf{10}_{k+2}$ also has a double-twisted structure. As for the spiral double-twisted structure $\mathbf{10}_{k+2}$ of the (k+2)-th gabion unit, the n-th upper steel wire $A_n$ moves again to the position of the n-th lower steel wire $B_n$ and is paired therewith. In such a state, the pair of steel wires proceeds.

The present invention will be described in connection with a most preferred embodiment in which the n-th upper steel wire $A_n$ moves again to the position of the n-th lower steel wire $B_n$ and then proceeds. Since this case has the same advantage as a case where upper and lower sliders of the gabion mesh manufacturing apparatus return to their initial positions and begin to operate again, it can be considered as the most preferred embodiment. Therefore, the n-th upper steel wire $A_n$ and the n-th lower steel wire $B_n$ proceed through repetition of the same processes as described above except only that a transverse steel wire inserted therebetween is a (k+2)-th transverse steel wire $C_{k+2}$.

The gabion unit of the present invention can be made by consecutively coupling the spiral double-twisted structure of the k-th gabion unit, the two spiral double-twisted structures of the (k+1)-th gabion unit, and the spiral double-twisted structure of the (k+2)-th gabion unit to one another.

The gabion mesh 100 of the present invention can be completed by constructing gabion units through the consecutive and repetitive coupling of spiral double-twisted structures $\mathbf{10}_k$, $\mathbf{10}_{k+1}$, $\mathbf{10}_{k+2}$, $\mathbf{10}_{k+}$ . . . for the series of gabion units of the present invention both in the right and left direction and in the fore and aft direction, and by consecutively and repeatedly coupling the gabion units both in the right and left direction and in the fore and aft direction.

As described above, the gabion unit of the present invention is characterized in that the spiral double-twisted structure $\mathbf{10}_k$ as a basic unit of the gabion unit has two spiral twisted structures, i.e. the front and rear spiral twisted structures that are rotated in opposite directions. This is essentially different from the conventional gabion unit in that both spiral twisted structures of a spiral double-twisted structure of the conventional gabion unit are rotated in only one direction. This enables implementation of full automation of a method for manufacturing a gabion mesh, which was impossible in principle in a conventional manufacturing method.

Further, although the gabion mesh 100 of the present invention has the front and rear spiral twisted structures that are formed through the rotations in opposite directions, the twisted structures thereof are not untwisted due to the transverse steel wire $C_k$. Therefore, the transverse steel wire $C_k$ provides a foundation for forming the front and rear spiral twisted structures in the manufacturing process, and simultaneously performs the functions of maintaining the existing states of the front and rear spiral twisted structures and preventing the untwisting thereof in the spiral double-twisted structure $\mathbf{10}_k$ of the completed gabion unit.

Although the gabion unit and the gabion mesh using the same according to the present invention have been specifically described above, the description has been made only in connection with the most preferred embodiment of the present invention. The present invention is not limited thereto, and the scope of the present invention is defined by the appended claims. Further, it will be apparent that those skilled in the art can make various modifications and changes upon reading of the description without departing from the scope of the present invention.

The invention claimed is:

1. A spiral double-twisted structure for a gabion unit of a gabion mesh, comprising:

an n-th upper steel wire ($A_n$) and an n-th lower steel wire ($B_n$) which are paired with each other and rotated in one direction to form a front spiral twisted structure having a plurality of twists, a k-th transverse steel wire ($C_k$) which is transversely inserted between the n-th upper steel wire ($A_n$) and the n-th lower steel wire ($B_n$) of the front spiral twisted structure, and the n-th upper steel wire ($A_n$) and the n-th lower steel wire ($B_n$) which are rotated in a direction opposite to the one direction after passing over the k-th transverse steel wire ($C_k$) serving as a centerline, in order to form a rear spiral twisted structure having a plurality of twists, where k represents the relative positional relationship among transverse steel wires and is a positive integer including 0, and n represents the relative positional relationship among the upper and lower steel wires and is a positive integer including 0.

2. A gabion unit including two longitudinal steel wires and one transverse steel wire, comprising:

a k-th spiral double-twisted structure including a k-th transverse steel wire ($C_k$), the k-th spiral double-twisted structure being configured such that an n-upper steel wire ($A_n$) and an n-th lower steel wire ($B_n$) are paired with each other and rotated in one direction to form a front spiral twisted structure having a plurality of twists, the k-th transverse steel wire ($C_k$) is transversely inserted between the n-th upper steel wire ($A_n$) and the n-th lower steel wire ($B_n$) of the front spiral twisted structure, and the n-th upper steel wire ($A_n$) and the n-th lower steel wire ($B_n$) are rotated in a direction opposite to the one direction after passing over the k-th transverse steel wire ($C_k$) serving as a centerline, in order to form a rear spiral twisted structure having a plurality of twists, where k represents the relative positional relationship among the transverse steel wires and is a positive integer including 0, and n represents the relative positional relationship among the upper and lower steel wires and is a positive integer including 0;

two (k+1)-th spiral double-twisted structures including a (k+1)-th transverse steel wire ($C_{k+1}$); and one (k+2)-th spiral double-twisted structure including a (k+2)-th transverse steel wire ($C_{k+2}$), where k represents the relative positional relationship among the transverse steel wires and is a positive integer including 0.

3. The gabion unit as claimed in claim 2, wherein the (k+1)-th spiral double-twisted structure is formed such that:

the n-th upper steel wire ($A_n$) is paired with an adjacent (n+1)-th lower steel wire ($B_{n+1}$) and an (n−1)-th upper steel wire ($A_{n-1}$) is paired with the n-th lower steel wire ($B_n$), and the pairs of steel wires are then rotated in the one direction to form front spiral twisted structures, respectively, the (k+1)-th transverse steel wire ($C_{k+1}$) is transversely inserted between the paired two longitudinal steel wires of each of the front spiral twisted structures, and the paired two longitudinal steel wires are rotated in the direction opposite to the one direction after passing over the (k+1 )-th transverse steel wire ($C_{k+1}$) serving as a centerline, in order to form a rear spiral twisted structure, where k represents the relative positional relationship among the transverse steel wires and is a positive integer including 0, and n represents the relative positional relationship among the upper and lower steel wires and is a positive integer including 0.

4. The gabion unit as claimed in claim 1, wherein the (k+2)-th spiral double-twisted structure is formed such that:

the n-th upper steel wire ($A_n$) is paired again with the n-th lower steel wire ($B_n$) and they are then rotated in the one direction to form a front spiral twisted structure, the (k+2)-th transverse steel wire ($C_{k+2}$) is transversely inserted between the paired upper and lower steel wires ($A_n$, $B_n$) of the front spiral twisted structure, and the paired upper and lower steel wires ($A_n$, $B_n$) are rotated again in the direction opposite to the one direction after passing over the (k+2)-th transverse steel wire ($C_{k+2}$) serving as a centerline, in order to form a rear spiral twisted structure, where k represents the relative positional relationship among the transverse steel wires and is a positive integer including 0, and n represents the relative positional relationship among the upper and lower steel wires and is a positive integer including 0.

5. A gabion mesh, comprising:

gabion units according to claim 2 consecutively and repeatedly coupled to one another both in a right and left direction and in a fore and aft direction.

6. A gabion mesh, comprising:

gabion units according to claim 3 consecutively and repeatedly coupled to one another both in a right and left direction and in a fore and aft direction.

7. A gabion mesh, comprising:

gabion units according to claim 4 consecutively and repeatedly coupled to one another both in a right and left direction and in a fore and aft direction.

8. The spiral double-twisted structure according to claim 1, wherein the spiral double-twisted structure is bisected by the k-th transverse steel wire ($C_k$).

9. The gabion unit according to claim 2, wherein the k-th spiral double-twisted structure is bisected by the (k+1)-th transverse steel wire ($C_{k+1}$).

* * * * *